US010542851B2

(12) United States Patent
Crooks

(10) Patent No.: US 10,542,851 B2
(45) Date of Patent: Jan. 28, 2020

(54) WALL-MOUNTED BACK BRUSH

(71) Applicant: Janice Leigh Crooks, Anchorage, AK (US)

(72) Inventor: Janice Leigh Crooks, Anchorage, AK (US)

( * ) Notice: Subject to any disclaimer, the term of this patent is extended or adjusted under 35 U.S.C. 154(b) by 909 days.

(21) Appl. No.: 14/277,945

(22) Filed: May 15, 2014

(65) Prior Publication Data

US 2015/0059110 A1 Mar. 5, 2015

Related U.S. Application Data

(60) Provisional application No. 61/873,870, filed on Sep. 5, 2013.

(51) Int. Cl.
*A47K 7/02* (2006.01)
*A46B 15/00* (2006.01)

(52) U.S. Cl.
CPC ..... *A47K 7/024* (2013.01); *A46B 15/0075* (2013.01)

(58) Field of Classification Search
CPC ... A46B 15/0075; A46B 15/0081; A46B 9/02; A47K 7/02; A47K 7/024
USPC ..... 15/110, 187, 160, 210.1, 104.92, 244.1
See application file for complete search history.

(56) References Cited

U.S. PATENT DOCUMENTS 4,023,567 A * 5/1977 Wessel ..... A61H 11/00 601/143
4,168,704 A * 9/1979 Wessel ..... A46B 3/16 15/110
4,943,018 A * 7/1990 Glaser ..... A47K 7/024 15/160
5,179,755 A * 1/1993 Hill, Jr. ..... A47K 7/024 15/160
5,228,165 A * 7/1993 Westberry ..... A47K 7/024 15/160
5,774,907 A 7/1998 Doggwiler
6,427,281 B1 8/2002 Simon
6,568,029 B1 5/2003 Letts
7,155,769 B1 * 1/2007 Baker ..... A47K 7/024 15/104.92
7,467,438 B2 12/2008 Ryman
8,631,523 B1 * 1/2014 Schneider ..... A47K 7/024 4/606
2009/0127045 A1 * 5/2009 Williams ..... A45C 7/0059 190/107
2013/0000660 A1 * 1/2013 Lopez ..... A46B 9/026 132/200

* cited by examiner

*Primary Examiner* — Shay Karls
(74) *Attorney, Agent, or Firm* — Global Intellectual Property Agency, LLC; Daniel Boudwin

(57) ABSTRACT

Described is a wall-mounted back brush comprising a base having a front surface and a back surface. A plurality of bristles are disposed on the front surface and extend outward therefrom. The bristles may be used to scratch, massage, or scrub a user's back as desired. The present invention further comprises an attachment means, such as suction cups, for securing the device to a wall or other surface. One or more grooves are disposed on the front surface of the base and are adapted to receive a plurality of massage nodules that can be removably secured within the grooves. The device may be mounted to a door by means of a plurality of loops of elastic cable having an anchor disposed thereon. The loops of elastic cable can be secured to the base and may be stretched around the corners of a door.

10 Claims, 3 Drawing Sheets

WALL-MOUNTED BACK BRUSH

CROSS REFERENCE TO RELATED APPLICATION

This application claims the benefit of U.S. Provisional Application No. 61/873,870 filed on Sep. 5, 2013, entitled "Bear Necessity." The above identified patent application is herein incorporated by reference in its entirety to provide continuity of disclosure.

BACKGROUND OF THE INVENTION

Field of the Invention

The present invention relates to wall mounted back brushes. More specifically, the present invention relates to a wall-mounted back brush having a base with bristles disposed on a front surface and having an attachment means for securing said base to a wall or similar surface. The back brush further comprises nodules that can be removably secured to grooves disposed on the front surface of the base. A user may press into the massage nodules in order to massage the user's back or otherwise relieve tension. The back brush can be mounted to a door by means of a plurality of elastic loops having an anchor thereon. The loops are threaded through apertures on the base of the back brush and the anchors secure the loops therein.

Many people find it difficult to wash, scratch, or massage their own backs without assistance from another person. Further, many people like to have their back massaged or scratched, but may be unable to adequately reach all portions of their back. In order to reach various locations on a person's back, the person must twist his or her body and strain his or her arms. This may be uncomfortable and may not allow the person to release tension in the person's back. Thus, it would be desirable to provide a device that allows a user to easily scrub and massage the user's back without assistance from a third-party.

Hand-held back brushes are known in the art and comprise a handle having a head with bristles disposed thereon. The hand-held back brush can be used to extend the user's reach such that the user is better able to reach all areas of the user's upper and lower back. Hand-held brushes, however, still require a user to stretch and twist to reach various areas of the back. Further, the hand-held brushes have a relatively small surface area such that only small regions of the back are contacted by the bristles at any given time. Lastly, the hand-held device requires the user to hold the device and thus limits the user's ability to use his or her hands for other purposes. Thus, a device is desired that allows a person to easily massage, scratch, or scrub his or her back in a hands-free manner.

The present invention provides a wall-mounted back brush comprising a base having a front surface and a back surface. A plurality of bristles are disposed on the front surface and extend outward therefrom. The base further includes an attachment means that allows the base to be secured to a wall or similar surface. The attachment means may include suction cups. The attachment means may also include elastic loops having anchors disposed thereon that are adapted to wrap around the corners of a door. The base comprises one or more grooves adapted to receive massage nodules having various shapes, such as hemispheres or cones. The massage nodules can be removably secured to the grooves and allow a user to press their backs into the nodules to massage the user's back or to relieve tension.

Description of the Prior Art

Devices have been disclosed in the prior art that relate to wall-mounted back brushes. These include devices that have been patented and published in patent application publications. These devices generally relate to wall-mounted back brushes for use in a shower. The following is a list of devices deemed most relevant to the present disclosure, which are herein described for the purposes of highlighting and differentiating the unique aspects of the present invention, and further highlighting the drawbacks existing in the prior art.

One such device is U.S. Pat. No. 5,228,165 to Westberry et al. entitled "Wall Mount Bath Brush and Method" which discloses a back brush having a plate portion with securing means on the back surface, such as suction cups, for attachment to a wall. The device further includes a plurality of clusters of bristles on the front surface. The device as disclosed may be provided in a variety of shapes such as rectangular, oval, or octagonal. Westberry, however, fails to disclose a wall mounted back brush having grooves adapted to receive nodules that can be used to massage a user's back. Further, Westberry does not disclose the use of elastic cables to attach the back brush to a door. Additionally, Westberry fails to disclose a back brush composed of a flexible material that can be rolled up into a compact configuration for storage or travel.

U.S. Pat. No. 5,774,907 to Doggwiler entitled "Shower Wall Back Scrubber and Massager" discloses a back scrubber for use in the shower that is able to removably attach to a wall. The back scrubber has a means for establishing fluid connection with the shower head such that water can flow through the back scrubber. Doggwiler does not disclose a back scrubber having grooves and removable nodules for massaging a user's back, and does not disclose elastic cables for attaching the back scrubber to a door. Instead, Doggwiler discloses the use of the back scrubber only in a shower or bathtub.

U.S. Pat. No. 6,427,281 to Simon entitled "Wall Mounted Bath Brush" discloses a bath brush that can be removably attached to a wall in a shower. The device comprises a frame having an opening in the middle, wherein bristles extend from the frame into the interior area. In this way, a person may stand in the interior area of the frame, and clean themselves by moving their body against the bristles. Thus, Simon does not disclose a back brush having a flat base that attaches to a wall, and instead discloses a frame that extends outward from the wall.

U.S. Pat. No. 6,568,029 to Letts entitled "Back Washing Assembly" discloses a scrubbing apparatus having a base adapted to secure to a shower wall, and a scrubbing portion that faces outwardly from the shower wall. The scrubbing portion comprises sponges and covers over said sponges. The scrubbing portion further comprises scrubbing pads. Therefore, Letts does not disclose a scrubbing device having a plurality of bristles and instead discloses a device that utilizes sponges or scrubbing pads.

U.S. Pat. No. 7,467,438 to Ryman entitled "Bare Back Scrubber" discloses a wall mountable device having a scrub pad secured to a plate that is secured to a wall by a plurality of legs. The scrub pad is composed of polyester fibers. A removable cloth cover may be fitted over the scrub pad to aid in applying lotions or creams. Thus, Ryman does not disclose the use of elastic cables to attach the scrub pad to a door, and Ryman only discloses the use of the scrub pad in a shower or bathtub.

Finally, U.S. Pat. No. 4,943,018 to Glaser et al. entitled "Wall-Mountable Back Brush" discloses a back brush having a plurality of bristles on a front surface and that can be attached to a wall by means of suction cups. The back brush is elongated and has a curvature between the top and bottom ends such that the back brush fits the lumbar region of a person's body. Therefore, Glaser et al. does not describe a wall mountable back brush having grooves and removable nodules that can be used to massage a user's back.

These prior art devices have several known drawbacks. Several devices known in the prior art describe wall mountable back brushes for use only in a shower. However, many users may desire to position a back brush in a bedroom or similar area. Further, the devices do not disclose the use of elastic cables to attach the back brush to a door, and instead generally rely on suction cups for attachment to various surfaces. Suctions cups may not be appropriate for mounting the back brush on a door which may have a variety of indentations and other stylistic carvings or grooves. Additionally, the devices known in the prior art do not disclose nodules on the back brush that the user can press against in order to massage the user's back or to otherwise release muscle tension. Furthermore, the devices in the prior art are not adapted to be rolled-up for storage or travel and placed within a cylindrical sheath.

In light of the devices disclosed in the prior art, it is submitted that the present invention substantially diverges in design elements from the prior art and consequently it is clear that there is a need in the art for an improvement to existing wall-mounted brush devices. In this regard the instant invention substantially fulfills these needs.

SUMMARY OF THE INVENTION

In view of the foregoing disadvantages inherent in the known types of wall-mounted brushes now present in the prior art, the present invention provides a new wall-mounted brush wherein the same can be utilized for providing convenience for the user when scratching, scrubbing, or massaging the user's back in a hands-free manner without assistance from another person.

It is therefore an object of the present invention to provide a new and improved wall-mounted brush device that has all of the advantages of the prior art and none of the disadvantages.

It is another object of the present invention to provide a wall-mounted brush that can be easily mounted to and removed from a wall or other surface.

Another object of the present invention is to provide a wall-mounted brush that comprises massage nodules that allow a user to massage his or her back by pressing against said nodules.

Yet another object of the present invention is to provide a wall-mounted brush that can be secured to a door by means of a plurality of loops of elastic cable.

Another object of the present invention is to provide a wall-mounted brush that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1A:
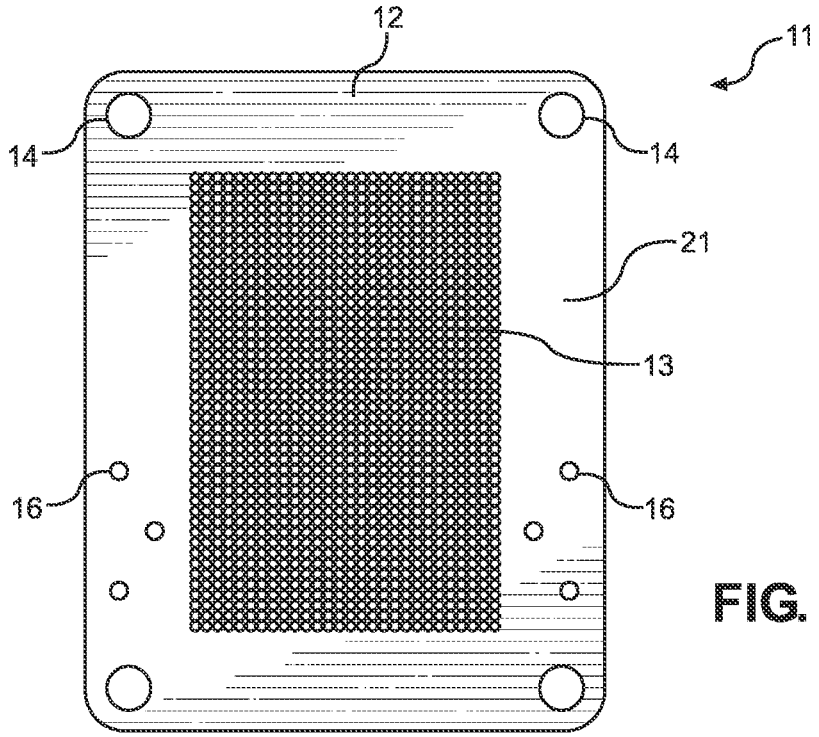
FIG. 1A shows a front view of an embodiment of the wall-mounted brush of the present invention.

Reference is made herein to the attached drawings. Like reference numerals are used throughout the drawings to depict like or similar elements of the wall-mounted brush. For the purposes of presenting a brief and clear description of the present invention, the preferred embodiment will be discussed as used for scrubbing, scratching, or massaging a user's back in a hands-free manner without the assistance of another person. The figures are intended for representative purposes only and should not be considered to be limiting in any respect.

Referring now to FIG. 1A, there is shown a front view of an embodiment of the wall-mounted brush of the present invention. The wall-mounted brush comprises a base 12 that is flat, flexible, and lightweight. The base 12 may be composed of rubber or a similar flexible, lightweight material. The base 12 is flexible such that it can be easily rolled up into a cylindrical shape for storage or travel when the device is not in use. When rolled up, the base 12 can be placed in a flexible, cylindrical sheath that helps to maintain the base 12 is maintained in a compact, rolled up configuration.

The base 12 comprises a front surface 21 on which a plurality of bristles 13 are disposed. The bristles 13 extend outward from the front surface 21 and form a brush-like surface. The bristles 13 may be arranged in a single cluster, or may be arranged in several clusters. In some embodiments the bristles cover the entire surface of the base and in other embodiments the bristles are located centrally on the base. The bristles 13 form a brush-like surface that a user may use to scrub, massage, or scratch his or her back. The bristles may have any of a variety of densities so as to suit the preferences of the particular user.

The front surface 21 of the base 12 further comprises one or more grooves 16 disposed thereon that are adapted to receive massage nodules. Further, some embodiments of the present invention include a plurality of apertures 14 disposed on the base 12 that are adapted to receive a hanging device. The apertures 14 may be used to assist in hanging or mounting the device and can engage with a variety of hanging devices such as hooks or cables as desired by the user.

Figure 1B:
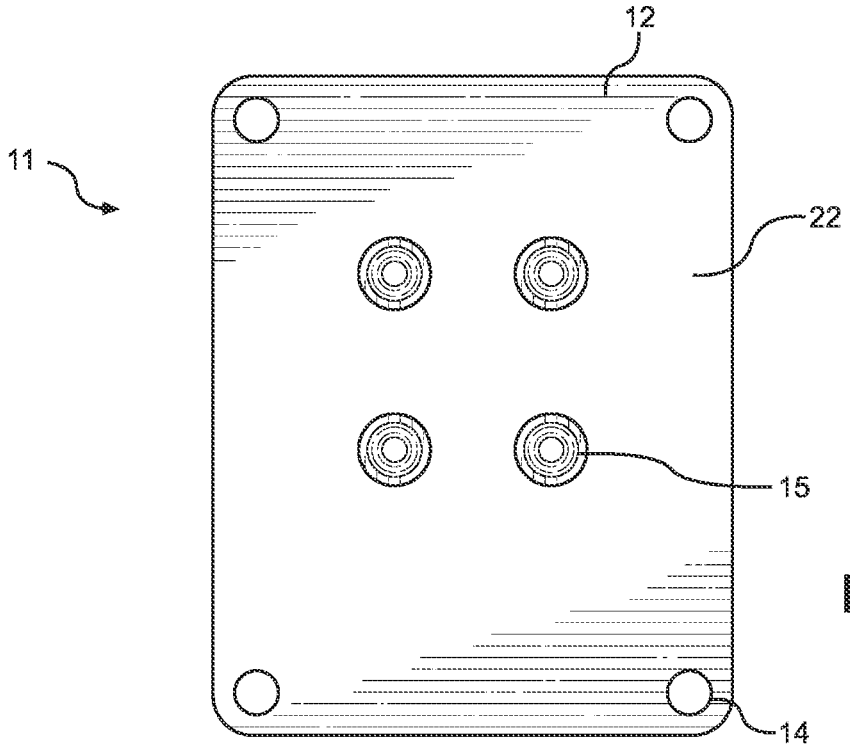
FIG. 1B shows a back view of an embodiment of the wall-mounted brush of the present invention.

Referring now to FIG. 1B, there is shown a back view of an embodiment of the wall-mounted brush of the present invention. In some embodiments of the present invention, the back surface 22 of the base 12 comprises a plurality of suction cups 15 adapted to secure said base 12 to a wall or other surface. The suction cups 15 may be used alone to secure the wall-mounted brush 11 to a surface, or may be used in combination with other hanging devices to better maintain the device in position on a wall or other surface.

Figure 2:
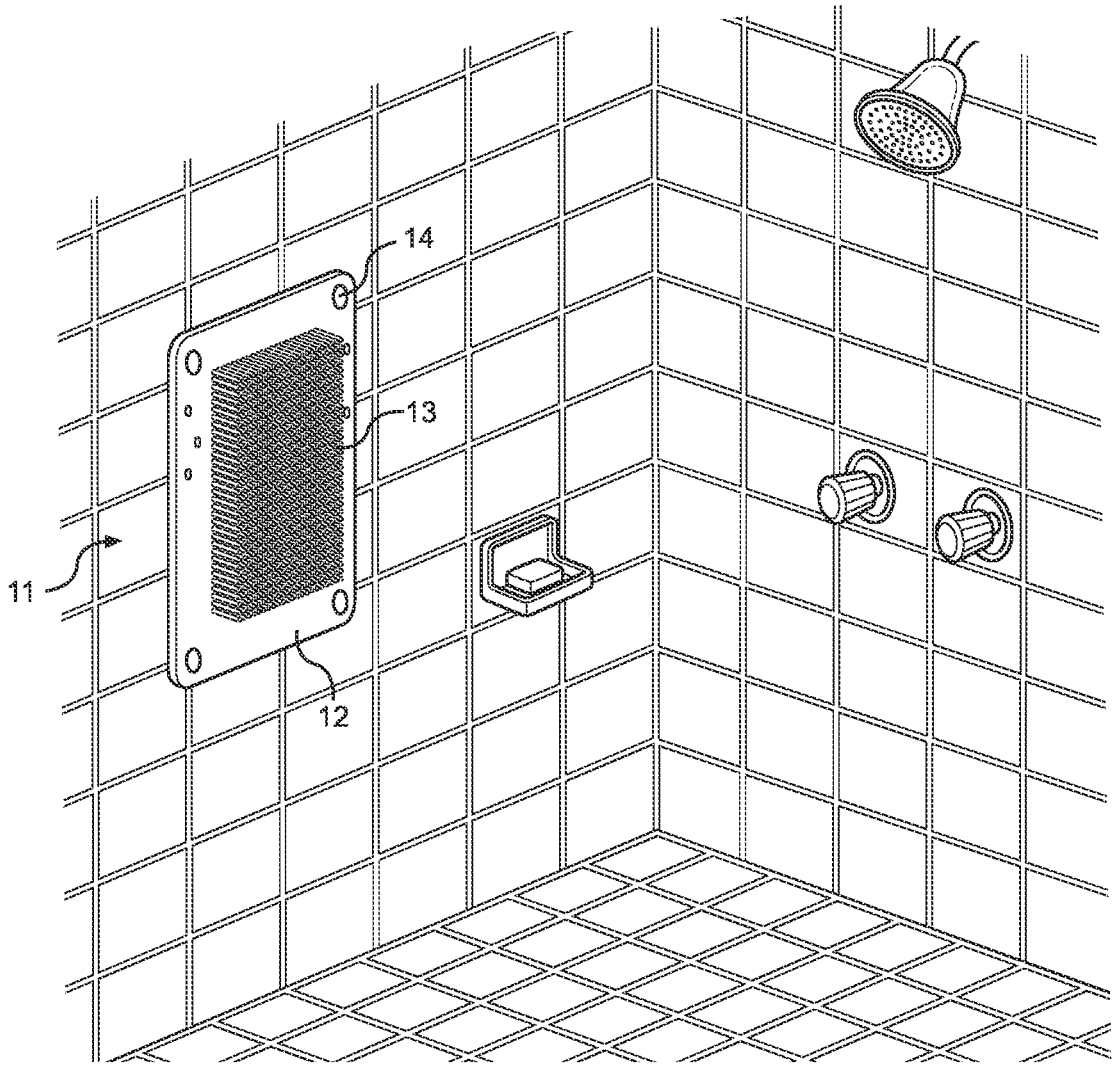
FIG. 2 shows a perspective view of an embodiment of the wall-mounted brush of the present invention as mounted on a wall.

Referring now to FIG. 2, there is shown a perspective view of an embodiment of the wall-mounted brush of the present invention as mounted on a wall. The base 12 is mounted on a wall at a suitable height for a user to utilize the bristles 13 on the base 12 for scrubbing or scratching the user's back. The wall-mounted brush 11 may be mounted on the wall of a shower or bathtub and can be used to clean or scrub a user's back. The user may wet the bristles 13 and put soap or lather on the bristles 13 so that the user can wash his or her back by moving his or her body against the bristles. The bristles may be composed of an absorbent material that will hold the water and soap thereon. In this way, the user can clean his or her back in a hands-free manner, without twisting and turning, simply by moving his or her body against the bristles as desired.

Figure 3:
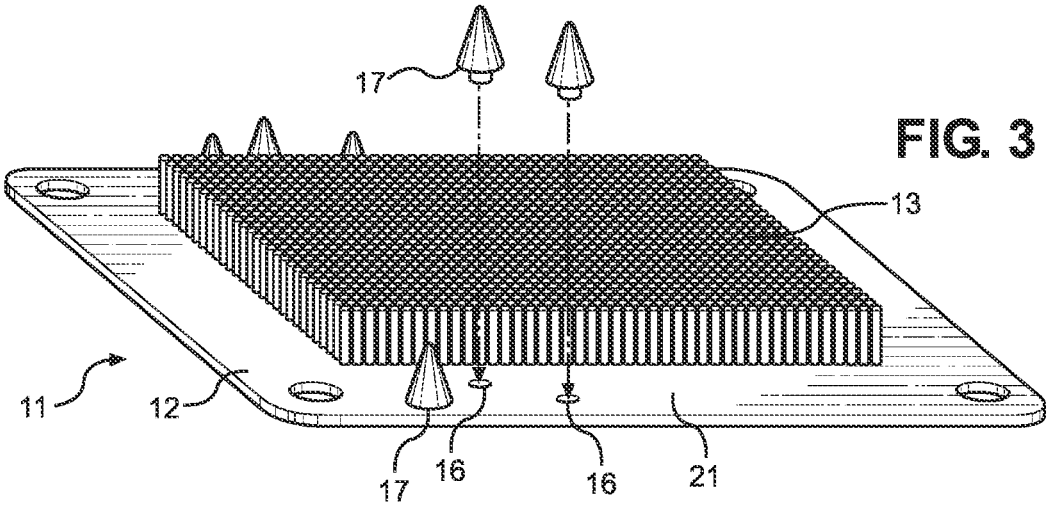
FIG. 3 shows a perspective view of an embodiment of the wall-mounted brush of the present invention and the massage nodules thereon.

Referring now to FIG. 3, there is shown a perspective view of an embodiment of the wall-mounted brush of the present invention and the massage nodules thereon. The wall-mounted brush comprises one or more grooves 16 disposed on the front surface 21 of the base 12 adapted to receive one or more massage nodules 17 therein. When inserted into the grooves 16, the massage nodules 17 extend outward therefrom. The massage nodules 17 may have any of a variety of shapes including a conical shape, a rounded or hemispherical shape, or a square shape. A user may press his or her back against the massage nodule in order to apply pressure to an area of soreness and to help massage a particular area. The massage nodules are adapted to aid a user in performing shiatsu massage or acupressure techniques. The massage nodules may be interchanged as desired by the user and can be easily inserted and removed into the grooves by snapping the nodules into place. In some embodiments of the present invention, the grooves 16 are disposed on an area of the base 12 adjacent to said bristles 13.

Figure 4:
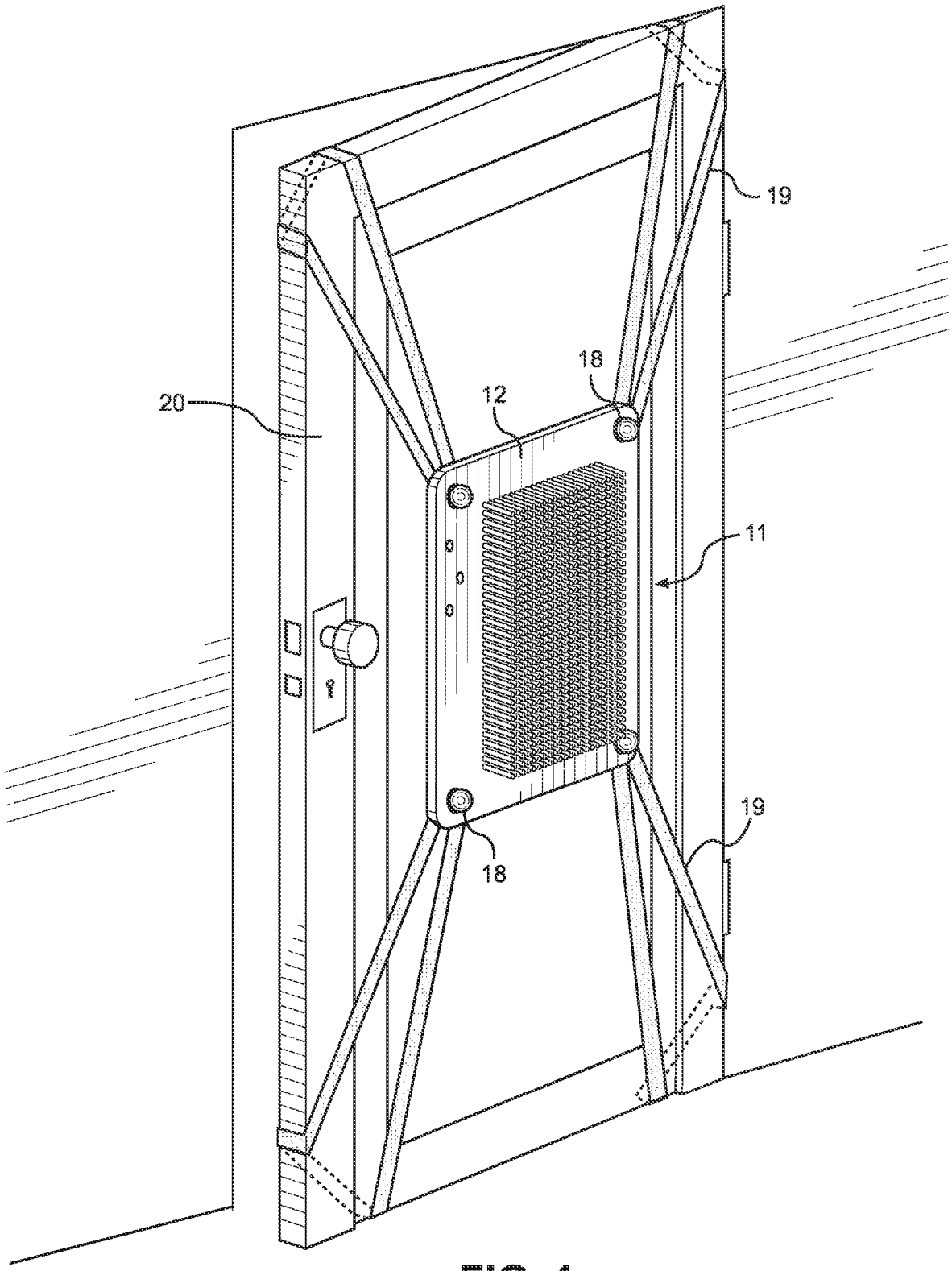
FIG. 4 shows a perspective view of an embodiment of the wall-mounted brush of the present invention as mounted to a door by loops of elastic cable.

Referring now to FIG. 4, there is shown a perspective view of an embodiment of the wall-mounted brush of the present invention as mounted on a door by means of loops of elastic cable. The wall-mounted brush 11 comprises a base 12 having a plurality of apertures 14 disposed thereon. The apertures 14 are shown as being positioned at the corners of the base 12, but may be arranged in other locations in other embodiments of the present invention. The device further comprises loops 19 of elastic cable having an anchor 18 disposed thereon. The anchors 18 are sized such that they are unable to pass through the apertures 14. In order to mount the wall-mounted brush using loops of elastic cable, the loops can be threaded through the apertures 14 from the front surface towards the back surface, and pulled through until the anchor 18 catches on the aperture 14. Then, the loops can be stretched over the corners of the door 20. By securing the loops of elastic cable around the four corners of the door, the base 12 can be mounted on the door 20 without the use of suction cups or other hanging means. This hanging arrangement may be desirable where the use of suction cups is not appropriate. For example, if the door has an uneven surface as result of carvings or decorative indentations on the surface of the door, suction cups would not be able to be able to grip the uneven surfaces of the door.

In order for a person to scrub or scratch his or her own back, the person must twist and strain in order to reach various locations on his or her back. Many people are simply unable to reach certain portions of their backs and require the assistance of another person to clean or scratch their backs. Hand-held brushes provide a user with a longer reach, but still require the user to twist their arms in order to scrub his or her back. Further, when using the hand-held brush the user is unable to use his or her hands for other purposes. Thus, a device that allows for hands-free scrubbing or scratching of a user's back is desired.

The present invention provides a wall-mounted brush comprising a base with a plurality of bristles disposed on the front surface thereof. The wall-mounted brush comprises an attachment means, such as suction cups, for securing the brush to a wall or other surface. The base comprises one or more grooves that are adapted to receive massage nodules having various shapes. Thus, the present invention provides users with a device that allows for hands-free scratching, scrubbing, or massaging of a user's back without the assistance of another person.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wall-mounted brush, comprising:

a base having a back surface and a front surface;

a plurality of apertures, wherein each aperture of the plurality of apertures is disposed at a corner of the base;

each of the plurality of apertures including an elastic loop threaded therethrough, the elastic loop including an anchor sized to not pass through the plurality of apertures;

a plurality of bristles disposed centrally on said front surface such that a portion of the base on said front surface forms a border around the plurality of bristles;

one or more grooves disposed on said front surface adapted to receive one or more massage nodules; and one or more massage nodules that are adapted to be removably inserted into said one or more grooves, wherein said one or more massage nodules extend outward from said one or more grooves when inserted therein, wherein each of the one or more massage nodules comprises a lower cylindrical portion connected to an upper conical portion, wherein a lower surface of the upper conical portion makes flush contact with the base when inserted in one of the one or more grooves;

wherein said base is securable to a door via attachment of each elastic loop to a corner of the door.

2. The wall-mounted brush of claim 1, wherein said base is flexible such that it can be rolled up for storage and placed within a cylindrical sheath.

3. The wall-mounted brush of claim 1, wherein said base is rectangular.

4. The wall-mounted brush of claim 1, wherein said base is elliptical.

5. The wall-mounted brush of claim 1, further comprising a plurality of suction cups disposed on said back surface of said base.

6. The wall-mounted brush of claim 1, wherein said plurality of bristles are positioned centrally on said base, and wherein said grooves are positioned on a portion of said base adjacent to said plurality of bristles.

7. The wall-mounted brush of claim 1, wherein said one or more massage nodules are hemispherical.

8. The wall-mounted brush of claim 1, wherein said plurality of bristles are absorbent such that said plurality of bristles can be used for washing a user's back.

9. The wall mounted brush of claim 1, wherein the one or more massage nodules comprises a first grouping of massage nodules disposed on a first side of the base and a second grouping of massage nodules disposed on a second side of the base, wherein the plurality of bristles are disposed between the first grouping and the second grouping.

10. The wall mounted brush of claim 9, wherein the first grouping includes three massage nodules arranged to form a first triangular perimeter, wherein the second grouping includes three massage nodules arranged to form a second triangular perimeter, wherein the first triangular perimeter and the second triangular perimeter are symmetrical.

* * * * *